US009119279B2

(12) United States Patent
Pawlowski et al.

(10) Patent No.: US 9,119,279 B2
(45) Date of Patent: Aug. 25, 2015

(54) RADIATION SOURCE FOR GENERATING SHORT-WAVELENGTH RADIATION FROM PLASMA

(71) Applicant: USHIO Denki Kabushiki Kaisha, Tokyo-to (JP)

(72) Inventors: Zbigniew Pawlowski, Kobylanka (PL); Jozef Antonius Willem Maria Corver, Nuenen (NL); Roy Mohede, Cologne (DE); Zenon Zajaczkowski, Dolaszewo (PL); Marcel Kennis, Brunssum (NL)

(73) Assignee: USHIO Denki Kabushiki Kaisha, Tokyo-to (JP)

( * ) Notice: Subject to any disclaimer, the term of this patent is extended or adjusted under 35 U.S.C. 154(b) by 0 days.

(21) Appl. No.: 14/499,281

(22) Filed: Sep. 29, 2014

(65) Prior Publication Data

US 2015/0090907 A1 Apr. 2, 2015

(30) Foreign Application Priority Data

Sep. 27, 2013 (DE) ..... 10 2013 110 760

(51) Int. Cl.
*H05G 2/00* (2006.01)

(52) U.S. Cl.
CPC ..... *H05G 2/005* (2013.01); *H05G 2/008* (2013.01)

(58) Field of Classification Search
USPC ..... 250/504 R
See application file for complete search history.

(56) References Cited

U.S. PATENT DOCUMENTS

| | | | | |
|---|---|---|---|---|
| 7,476,886 | B2 | 1/2009 | Bykanov | |
| 7,531,820 | B2 | 5/2009 | Hergenhan | |
| 7,649,187 | B2 | 1/2010 | Hergenhan | |
| 7,800,026 | B2 | 9/2010 | Lee | |
| 8,040,033 | B2 | 10/2011 | Zhokhavets | |
| 8,067,756 | B2 | 11/2011 | Ueno | |
| 2007/0090304 | A1 | 4/2007 | Jonkers | |
| 2015/0108365 | A1* | 4/2015 | Niimi et al. | 250/429 |

FOREIGN PATENT DOCUMENTS

| | | | |
|---|---|---|---|
| DE | 10147454 | A1 | 4/2003 |
| DE | 102009020776 | A1 | 11/2010 |
| WO | 2005101924 | A1 | 10/2005 |
| WO | 2008027158 | A2 | 3/2008 |

* cited by examiner

*Primary Examiner* — Kiet T Nguyen
(74) *Attorney, Agent, or Firm* — Patentbar International, P.C.

(57) ABSTRACT

A radiation source is provided for generating short-wavelength radiation from plasma in which a molten liquid metal is used as a source material. In the radiation source having a revolving element for providing the source material, unused source material exiting from the plasma zone has to be reliably collected to prevent impairments of the radiation source through unused source material. This aim is met in that a receptacle for the unused source material is constructed as a catch trough having a trough opening below the plasma zone and the molten bath in direction of gravity force as well as an inclined side wall to catch the source material and concentrate it in a deepest catch trough area. A heating element and at least one temperature sensor are fastened to the catch trough for heating the source material and controlling its temperature above its melting temperature.

21 Claims, 7 Drawing Sheets

RADIATION SOURCE FOR GENERATING SHORT-WAVELENGTH RADIATION FROM PLASMA

RELATED APPLICATIONS

This application claims priority to German Patent Application No. DE 10 2013 110 760.5, filed Sep. 27, 2013, which is incorporated herein by reference in its entirety.

FIELD OF THE INVENTION

The invention is directed to a radiation source for generating short-wavelength radiation from plasma in which there is provided a molten bath of a liquid metal as a source material for generating plasma, at least one revolving element which is partially immersed in the source material is arranged to carry source material into a plasma zone for generating plasma and at least one laser for exciting the source material in the plasma zone is locally directed to a location of the revolving element.

The invention is used in radiation sources for generating extreme ultraviolet (EUV) radiation with wavelengths under 50 nm, particularly in EUV radiation sources for semiconductor lithography (with wavelengths under 15 nm) for fabrication of integrated circuits with very small feature widths.

BACKGROUND OF THE INVENTION

In known EUV radiation sources the radiation emission is generated through excitation of hot plasma from a source material, the plasma having emission lines in the EUV spectrum. For plasma generation, the source material must be excited inside a vacuum chamber from which the generated EUV radiation is then coupled out.

There are two established methods in the prior art for providing the source material in an EUV radiation source.

In a first method, the source material is provided in the form of individual droplets which cross through a plasma zone. In the plasma zone, individual droplets, as mass-limited target volume for excitation of a laser-generated plasma (LPP—Laser-Produced Plasma), are impinged by pulsed laser radiation. Such an EUV radiation source using an LPP is disclosed in the document WO 2008/027158 A2. There the radiation source has a vacuum chamber in which is arranged a feed device that can supply liquid source material either in droplet form or as a thin liquid column. Aside from metallic tin also tin bromides or tin hydride and tin alloys are used as liquid source materials.

In a second method, the source material is provided in the form of a thin layer on revolving elements, wherein the revolving element is at least partially immersed in a bath of the source material and transports the source material on its surface into a plasma zone in which the excitation of the source material takes place. This way of providing the source material also opens up the use of an LPP, with the generation of plasma being carried out directly through pulsed radiation of a laser beam focused on the surface of the revolving element, wherein the revolving element under the laser focus continuously provides fresh source material for the generation of an LPP.

On the other hand, revolving elements can also be used as electrodes facing one another for plasma generated through electric discharge (DPP—Discharge-Produced Plasma). In this case, the emitting plasma is generated through the discharge current between the electrodes. In this way of plasma generation, mostly a laser in the plasma zone is additionally directed to one of the revolving elements (electrodes) for local evaporation of the source material to prepare the source material in gaseous and pre-ionized form (cold plasma) for the discharge. Plasma generated in such a way is sometimes also called LDP plasma (LDP—Laser-Assisted Discharge-Produced Plasma). Such sources are described in detail, for instance, in the patent documents WO 05/101924 A1, U.S. Pat. No. 7,531,820 B2, U.S. Pat. No. 7,800,026 B2, U.S. Pat. No. 7,649,187 B2 and U.S. Pat. No. 8,040,033 B2.

In all cases described above the source material is impinged upon in the plasma zone by energy pulses to generate the EUV radiation-emitting plasma. A very small portion of the source material hit by the energy pulses (e.g. a droplet or a local area of a coating) is consumed through evaporation and ionization under this energy input, while the larger portion remains unused and falls downward through the force of gravity. To prevent contamination of the radiation source by evaporated and/or unused source material and so that the unused portion of the source material can be reused, arrangements are provided in the radiation source for catching the unused source material and for deflecting it into the immersion bath for electrode coating.

The only one of the above-named patent documents dealing in detail with catching unused source material is the aforementioned WO 2008/027158 A2. There a collecting receptacle is arranged below the plasma zone to catch the unused portion of the source material falling through the plasma zone. The collecting receptacle has a small opening at the top through which the source material falls into the collecting receptacle. The cross section of the opening is on the order of magnitude of the droplets or the thin column (jet) of source material. To facilitate collection of the source material, a negative pressure is generated in the collecting receptacle causing the unused portion of the source material to be sucked in through the upper opening of the collecting receptacle. Furthermore, the beam dump, which is necessary for the laser beam, is used to catch the unused portion of the source material that is projected from the plasma zone. Referring to the direction of the laser beam, the beam dump is arranged downstream of the source material falling through the plasma zone and primarily absorbs the unused laser radiation. To this end, aside from an opening directed to the laser beam, the beam dump has a cavity which has a funnel-shaped bottom and a discharge opening to a collecting receptacle so that the unused portion of the source material collected in the cavity can be removed. A negative pressure can be generated in the cavity to facilitate collection so that even very small, light particles of the unused source material can be caught.

The problem of catching unused source material is only described for LPP sources with a continuous (jet) or discontinuous (droplet) target beam, since such a beam of source material always transports more material through the plasma zone than can be used by the pulsed laser beam.

Regarding DPP sources with revolving electrodes, for instance in the above-mentioned U.S. Pat. No. 8,040,033 B2, it is assumed that only deflecting objects are needed which carry the source material back into the immersion baths for the continuous coating of the revolving electrodes. However, this solution involves the risk of a solidification of unused source material on the deflecting object followed by additional discharges or short circuits or repeated evaporation close to the plasma, causing the failure-free operation period of the radiation source to be extremely shortened.

SUMMARY OF THE INVENTION

It is the object of the invention to find a novel possibility which allows unused source material projected from the plasma zone or exiting therefrom in some other way to be reliably collected in a simple manner in a radiation source having a revolving element for providing the source material in order to prevent impairments of the radiation source through debris of this source material. A further object consists in detecting impairments of the radiation source based on the collected unused portion of the source material and controlling the replacement of the consumed portion of the source material in the radiation source.

According to the invention, the object for a radiation source for generating short-wavelength radiation from plasma in which there is provided a molten bath of a liquid metal as a source material for plasma generation, at least one revolving element which is partially immersed in the source material is arranged to carry source material into a plasma zone for generating plasma, at least one laser for exciting the source material in the plasma zone is locally directed to a location of the revolving element and a receptacle for collecting unused source material is provided, is met in that the receptacle for the unused source material is constructed as a catch trough which has a trough opening below the plasma zone and below the molten bath in direction of the force of gravity as well as at least one inclined side wall to extensively catch the unused source material and concentrate it in a deepest trough area of the catch trough, that at least one heating element is fastened to the catch trough to heat the unused source material to a temperature above a melting temperature $T_S$ of the source material and that a control unit is provided for controlling the temperature of the unused source material in the catch trough with at least one temperature sensor fastened to the catch trough.

The catch trough is advantageously constructed as a double-walled vessel comprising an inner trough receiving the unused source material and an outer trough enclosing the inner trough. To this end, the inner trough can preferably be separated from the outer trough.

To this end, there is provided a gap between the inner trough and the outer trough for thermally insulating them from one another.

Advantageously, there is a heating element located in the gap.

In another variation, the gap is suitably provided for circulation of a coolant. The coolant preferably has a temperature T controlled by the control unit, wherein the unused source material is temperature-controlled above the melting temperature $T_S$ in the range $T_S<T<T_S+150$ K.

In a preferred embodiment, the catch trough has at least two side walls facing one another which are arranged so as to converge in the middle of the catch trough and be inclined in direction of the force of gravity.

Advantageously, at least the inner trough of the catch trough consists of a resistant, thermally and electrically conductive material, wherein at least the inner trough of the catch trough is preferably fabricated from stainless steel sheet. At least the inner trough of the catch trough preferably has a TiN coating to increase resistance.

The catch trough suitably has a filling level sensor for determining a filling level of the unused source material located in the catch trough.

A catch plate is advantageously arranged above the catch trough to extend the catching area of the catch trough, wherein the catch plate is inclined to the catch trough and has a drip edge terminating in or above the catch trough. Preferably, the catch plate is electrically insulated from the catch trough and the drip edge can be used as filling level sensor.

Advantageously, the catch plate has at least one additional heating element and one additional temperature sensor.

In a particularly preferred arrangement, the catch trough can be removed from the radiation source. To this end, lifting eyes are fastened to the catch trough for removing the catch trough from the radiation source.

The control unit preferably has a PID controller for controlling the heating elements on the basis of the temperature T of the unused source material determined by at least one temperature sensor. To this end, it is advantageous that at least one temperature sensor is arranged at the catch trough below a minimum filling level of the unused source material.

The control unit has means for detecting temperature jumps with which a sudden increase in the unused source material exiting from the plasma zone can be detected as a fault.

BRIEF DESCRIPTION OF THE DRAWINGS

The invention will be described in the following with reference to embodiment examples. The accompanying drawings show.

DETAILED DESCRIPTION OF THE PREFERRED EMBODIMENTS

Figure 1:
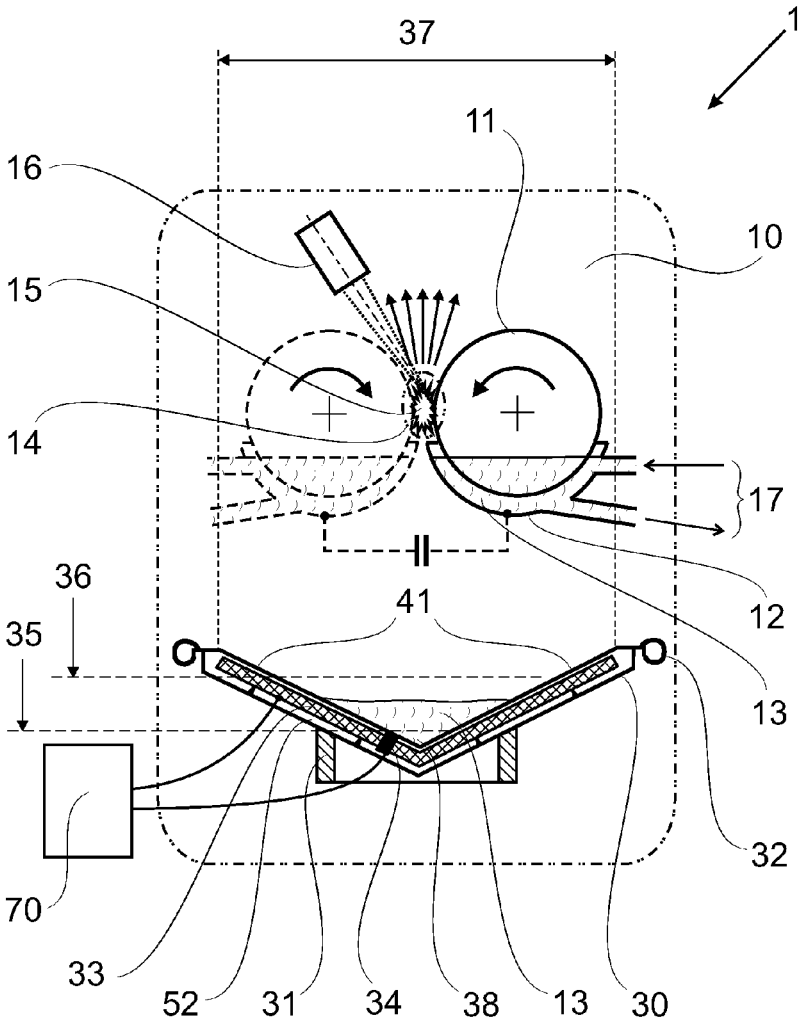
FIG. 1 is a schematic depiction of an EUV radiation source with a revolving element for providing the emitter material for plasma generation.

As is shown in FIG. 1, a radiation source 1 basically comprises at least one revolving element 11 which renewably supplies a source material 13 for generating an EUV-emitting plasma 15 in a plasma zone 14, a vessel 12 with a molten liquid metal as the source material 13 in which the revolving element 11 is at least partially immersed, at least one laser 16 which is directed to the revolving element 11 and which is focused on a location of the revolving element 11 in the plasma zone 14 for heating the source material 13, and a catch trough 30 for catching unused source material 13 exiting from the plasma zone 14. At least one heating element 33 is arranged at the catch trough 30. The catch trough 30 has at least one temperature sensor 34 and a control unit 70 for controlling the temperature.

According to FIG. 1, a vacuum chamber 10 receives the vessel 12 with the source material 13 and at least one revolving element 11 and the catch trough 30 of the radiation source 1.

The revolving element 11 in this example is disk-shaped and circular and is arranged so as to be rotatable around the horizontal axis of rotation through the vessel 12. In the vessel 12 the metallic source material 13 is supplied in form of a molten bath in which the revolving element 11 is partly immersed when rotating. As the revolving element 11 rotates through the molten bath, liquid source material 13 that adheres through adhesion forces is received at the circumference of the revolving element 11 which is immersed in the molten bath, so that it wets a peripheral area of the revolving element 11.

The revolving element 11 transports the source material 13 into the plasma zone 14 inside the vacuum chamber 10. The laser 16 which is operated in pulsed mode and is focused on the edge of the revolving element 11 locally heats the source material 13 and is provided with fresh source material 13 with each pulse due to the rotation movement. The laser 16 can either be exclusively used for generating the plasma 15 emitting the short-wavelength radiation (LPP=Laser-Produced Plasma) or—alternatively—only trigger an evaporation (pre-ionization) of the source material 13, wherein two revolving elements 11 (one of which is adumbrated with dotted lines in FIG. 1) as electrodes in the plasma zone 14 cause an electric discharge throughout the evaporated source material 13 so that the emitting plasma 15 is generated as discharge plasma (DPP and LDP respectively).

In the variation shown in FIG. 1—without limiting generality—the source material 13 coating the circumference of the revolving element 11 is heated, evaporated and ionized by the laser 16 to generate a hot plasma 15. The location at which the plasma 15 is generated by the laser 16 is the plasma zone 14. An alternative situation using two revolving elements 11 will be described in more detail with reference to FIG. 2.

The source material 13 in form of a metal having emission in the EUV range (e.g. lithium, tin) which is adjusted to a temperature (of preferably 5 to 10 Kelvin) above the melting temperature (180.5° C. and 232° C. respectively) is accordingly used as the liquid metal in form of the molten bath.

Aside from using the molten bath of the liquid metal as source material 13, it can be used simultaneously as coolant for the revolving element 11. As a result of the excitation of the source material 13 by means of the laser 16 to form hot plasma 15, the revolving element 11 can be heated very highly within a short time. The absorbed heat can be transferred to the molten bath when immersing the revolving element 11. The radiation source 1 has a cooling system 17 for dissipating the heat absorbed by the source material 13 in the molten bath. The cooling system 17 is connected to the vessel 12 for the molten bath as a circuit. It continuously removes the molten bath heated by the revolving element 11 from the vessel 12 while simultaneously supplying cooled molten bath that is temperature-controlled to just above the melting point of the source material 13. This cooling system 17 is not described more fully, since it is not essential for the subject matter of the invention.

The generation of plasma 15 in the radiation source 1 is carried out under high vacuum. To produce the vacuum (under 10 Pa), the radiation source 1 has a vacuum chamber 10 that is completely enclosed and closed off (in the sense of being sealed relative to the environment). The vacuum chamber 10 comprises all of the component parts of the radiation source 1 described above.

As the intensity of the EUV radiation generated in the radiation source 1 increases, a multiplicity of particles, very small droplets or spatters of source material 13 generated during plasma generation, aside from the consumed source material 13, are projected from the plasma zone 14 into the vacuum chamber 10. The consumed source material 13 is no longer available for plasma generation, wherein the portion of the consumed source material 13 is so small in relation to the projected source material 13 that it can be neglected. The projected source material 13 is unused source material 13 which is also no longer available for plasma generation.

The unused source material 13 exiting from the molten bath either results from operating errors in the radiation source 1 causing the molten bath to overflow from the vessel 12, or from the plasma generation where a portion of the source material 13 is projected from the plasma zone 14, falls downward or precipitates. This unused source material 13 is to be caught in the way described in the following.

The catch trough 30 is arranged inside the vacuum chamber 10 below the revolving element 11 and vessel 12 filled with source material 13 so as to catch any form of unused source material 13 exiting from the plasma zone 14 and falling downward through the force of gravity.

The catch trough 30 has a trough opening 37 which is larger than a projected outline of the revolving element 11 together with the vessel 12 for the molten bath in direction of the force of gravity, so that even splashes of the source material 13 which are flung farther out of the vessel 12 or plasma zone 14 can be reliably caught. A fixed maximum filling level 36 of the catch trough 30 for the unused source material 13 is generally about 5 to 6 liters. When reaching the maximum filling level 36 the catch trough 30 needs to be emptied or exchanged by manual maintenance of the radiation source 1.

The catch trough 30 has a double-walled construction comprising an inner trough 40 and an outer trough 50.

The unused source material 13 is received exclusively in the inner trough 40. To this end, the inner trough 40 has the shape of an inverted flat gabled roof, hip roof, mansard roof or barrel roof with side walls 41 converging in the middle to a deepest trough area 38 so that all of the unused source material 13 that is caught can collect in the middle along the inner trough 40.

Source material 13 exiting from the vessel 12 cools very quickly outside the molten bath. Exiting splashes or overflowing unused source material 13 would solidify within a short time and lead to the formation of thick layers, stalactites or even columns of solidified source material 13, which would have to be eliminated at considerable expense. To prevent this, the unused source material 13 caught in the catch trough 30 is always kept in a molten state.

To this end, the heating element 33 is arranged in the outer trough 50. It directly faces the converging side walls 41 of the inner trough 40 and runs parallel to the side walls 41. A heating wire which is arranged so as to be uniformly distributed in relation to the outer sides of the side walls 41 of the inner trough—preferably in a zigzagging manner—is preferably used as heating element 42.

The inner trough 40 and the unused source material 13 received therein are heated through thermal radiation emitting from the heating element 33 or thermal conduction through support contact. The inner trough 40 is made of a chemically and mechanically resistant material with good thermal conductivity so that the source material 13 received in the inner trough 40 can be heated without losses and with a slight time delay. Chemical resistance is mainly defined by the resistance of the material to electrochemical corrosion caused by the source material 13, which is fostered as the temperature rises. Mechanical resistance mainly refers to the strength of the material or of the material surface, which reduces the wear of the material caused by source material 13 that is flowing and therefore causing friction.

The material preferably used for the catch trough 30 is stainless steel sheet, which seems sufficiently resistant to the usable source materials 13 and their melting temperatures. For a good heat transfer to the inner trough 40 the heating element 33 as electrically insulating resistant heating wire is fastened in the outer trough 50 so as to run along the side walls 41 of the inner trough 40 without or with a rather small gap 52. For measuring temperature, at least one temperature sensor 34 is fastened in the outer trough 50 so as to directly come into contact with one of the facing outer sides of the side walls 41 of the inner trough 40. The temperature sensor 34 is arranged below a fixed minimum filling level 35 of the source material 13 in the deepest trough area 38 of the inner trough 40 so that it can determine the temperature of the unused source material 13 concentrated in the middle of the inner trough 40 even when reaching the minimum filling level 35.

Both heating element 33 and temperature sensor 34 are connected to the control unit 70. By means of the control unit 70, the temperature of the collected unused source material 13 is monitored and the heating element 33 is controlled corresponding to the results of the temperature measurement. When using tin, the molten bath is temperature-controlled to temperatures above the melting temperature $T_S$ up to a maximum of 400° C. The control unit 70 is also suitable for controlling the heating element 33 according to fixed temperature profiles. For example, an appreciably higher temperature can be used for liquefying a solidified unused source material 13 at the start of the heating process.

The inner trough 40 is surrounded by the outer trough 50 which is primarily used for receiving and stabilizing the inner trough 40 and as mechanical protection for the heating element 33 and temperature sensor 34 which are shielded from the unused source material 13. The inner trough 40 is positioned with its outer edge on the outer edge of the outer trough 50. To this end, the edge of the inner trough 40 is horizontally extended in the shape of a frame. The edge of the outer trough 50 is provided with a plurality of very small support points 51 as support for the edge of the inner trough 40. This reduces the heat transfer between the inner trough 40 and outer trough 50 to a minimum.

Excepting the support points 51, there only remains a gap 52 between the inner trough 40 and outer trough 50 so that the inner trough 40 and the heating element 33 are thermally insulated from the outer trough 50 and the vacuum chamber 10 of the radiation source 1. The gap 52 affords sufficient space for receiving the heating element 33 and temperature sensor 34.

The inner trough 40 can be removed from the radiation source 1. To separate the inner trough 40 from the outer trough 50 and the vacuum chamber 10 respectively, at least three lifting eyes 32 (for stable three-point linkage) are fastened to the edge area of the inner trough 40 which allow the inner trough 40 to be lifted by means of a crane and, for instance, to be replaced by another inner trough 40.

The entire catch trough 30 with the outer trough 50 is deposited on and removably fastened to a supporting frame 31 inside the vacuum chamber 10. The outer trough 50 is also made of stainless sheet steel.

Figure 2:
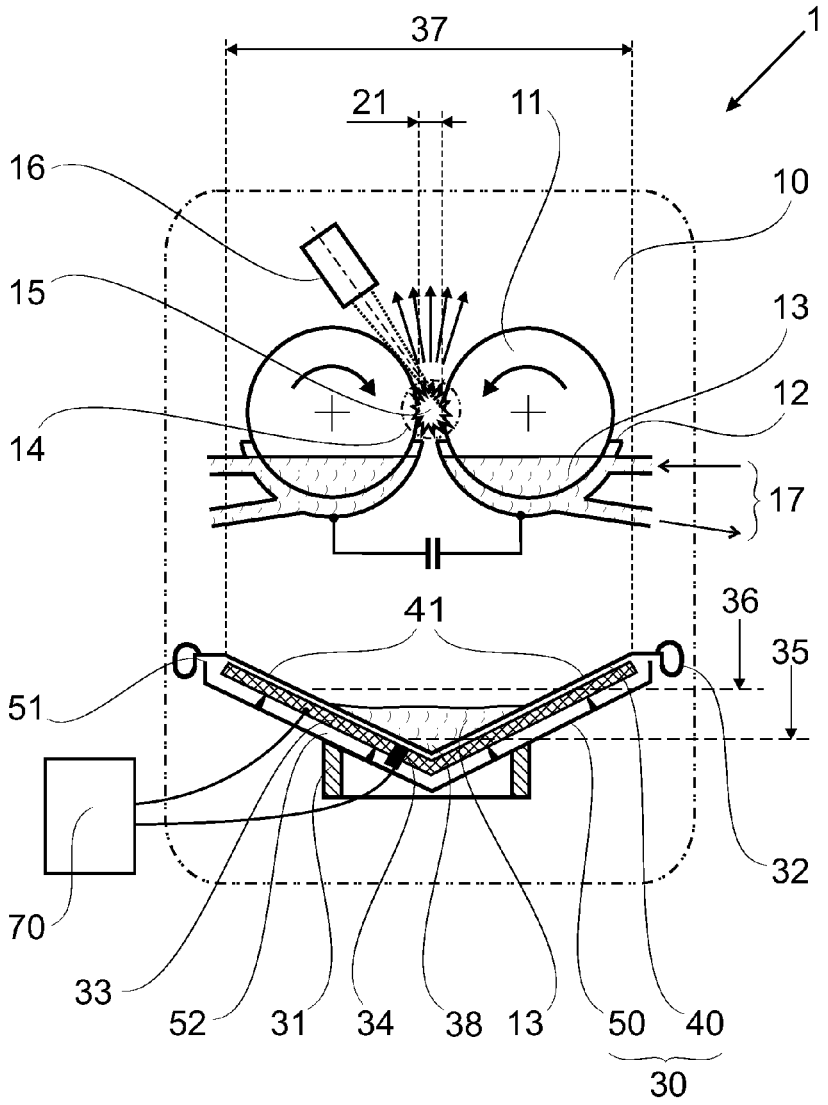
FIG. 2 is a basic construction of an EUV radiation source with two revolving electrodes for generating a gas discharge plasma (GDP)

In a second embodiment example, two revolving elements 11 are used in the form of circular disk electrodes to generate the plasma 15 in the radiation source 1. As shown in FIG. 2, the revolving elements 11 are arranged upright and side by side in the radiation source 1 with horizontally oriented axes of rotation so that they are facing each other at one point of their circumferences. An electrode gap 21 with a strong electric field remains between the two revolving elements 11. In the electrode gap 21 The source material 13 coating the revolving elements 11 is evaporated and ionized by the laser 16 to trigger a gas discharge in the electrode gap 21. During the gas discharge, the EUV radiation-emitting plasma 15 (LDP=Laser-Assisted Discharge-Produced Plasma) is generated.

Each of the revolving elements 11 has its own vessel 12 in which the revolving element 11 is electrically and thermally contacted via the respective molten bath of metallic source material 13, and its own cooling system 17. To set up the electric field, both the vessels 12 and the cooling systems 17 have to be electrically insulated from one another.

To catch source material 13 exiting from both vessels 12, the trough opening 37 of the catch trough 30 is larger than the outline of the two revolving elements 11 together with the two vessels 12 in direction of the force of gravity. In this embodiment, the heating of the collected source material 13 to temperatures above the melting temperature also prevents the occurrence of short circuits which are caused by exiting or deposited source material 13 and can lead to an electrical connection (coating, column or stalactite formation) between the two vessels 12 or between one vessel 12 and the catch trough 30.

Figure 3:
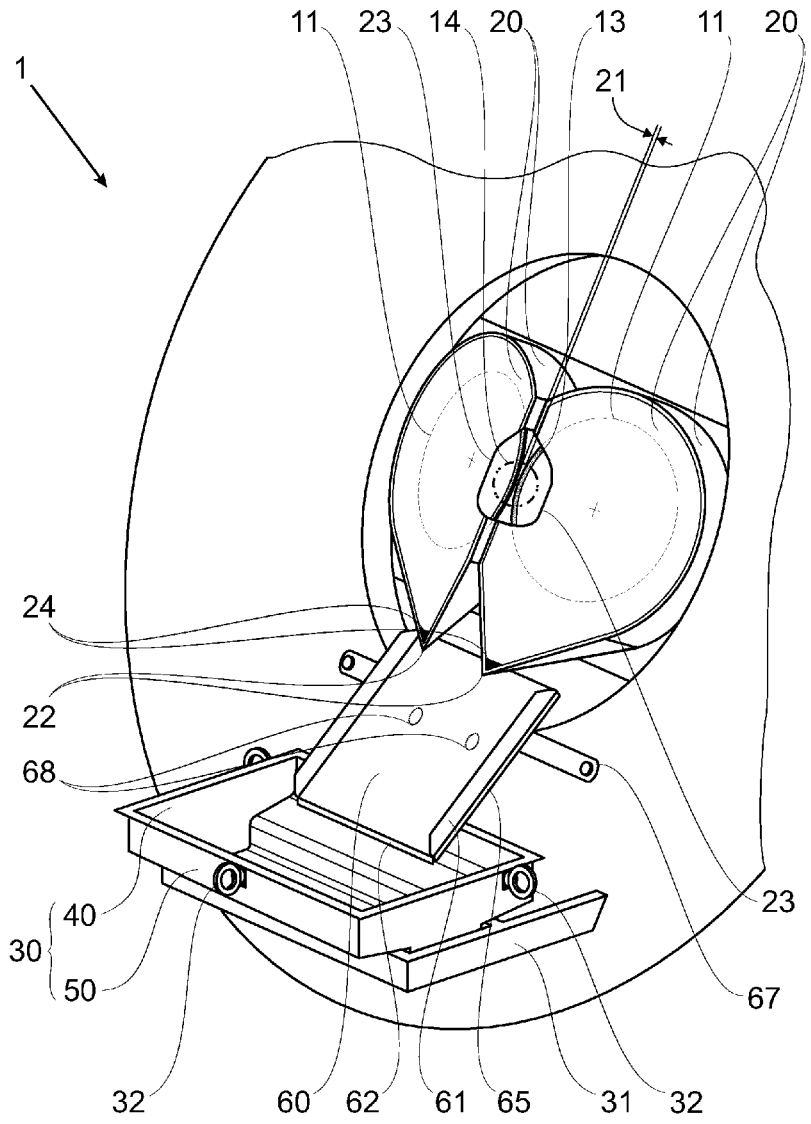
FIG. 3 shows an example of a DPP radiation source (image section showing the essential elements) with inclined rotating disk electrodes which are angled against one another using a catch trough with an additional catch plate.

In a preferred third embodiment example shown in FIG. 3, the radiation source 1 operates according to the principle described in the previous embodiment example. Inside the vacuum chamber 10 which has a cylindrical shape here (FIG. 3 showing only a section of the vacuum chamber 10) and a circular footprint, the two revolving elements 11 are opposing each other in form of disk electrodes at an obtuse or straight angle and are slightly tilted from the vertical. The revolving elements 11 are each received in an electrode housing 20 within which they are virtually completely enclosed. At the directly opposing sides of the electrode housings 20, each of the latter has a first opening 23 through which approximately one eighth of the circumference of the revolving elements 11 is exposed. At a point on the exposed circumference, the revolving elements 11 approach one another to the maximum extent leaving open the electrode gap 21.

The vessels 12 for receiving the source material 13 (hidden by the electrode housing 20 in FIG. 3) into which the revolving elements 11 dip from above by a portion of their circumference are arranged respectively inside the electrode housing 20 in a part below the revolving elements 11 that it directed downward in direction of the force of gravity. As the revolving elements 11 rotate through the source material 13, the latter is transported into the electrode gap 21 in the form of a coating on the circumference of the revolving elements 11.

The electrode housings 20 extend in direction of the force of gravity below the vessels 12 so as to end in the shape of a tip 22. The tips 22 are a lowest point of the electrode housings 20. At the tips 22, the electrode housings 20 have a second opening 24 through which source material 13 that has penetrated into the electrode housings 20 can exit the electrode housings 20.

To catch source material 13 penetrated into the vacuum chamber 10 or exiting from the electrode housings 20, the catch trough 30 is arranged below the electrode housings 20.

The strong electric field is generated between the two revolving elements 11 through voltage. In the plasma zone 14, which is located in the area of the smallest electrode gap 21, the source material 13 adhering to the circumference of the revolving elements 11 is ionized by the pulsed laser 16 (not shown in FIG. 3) impinging on one of the revolving elements 11. As a result of the strong electric field which is switched synchronously to the pulse regime of the laser 16 the gas discharge and the generation of emitting plasma 15 (not shown in FIG. 3) come about in the electrode gap 21.

The particles, small droplets or splashes projected from the plasma zone 14 during the gas discharge are for the most part already caught and collected inside the electrode housings 20 and are discharged into the catch trough 30 via the second openings 24 in the tips 22 of the electrode housings 20.

As a result of the gas discharges the revolving elements 11 can be very highly heated within a short time. Therefore, the tin preferably used as source material 13 is also used as coolant for the revolving elements 11. The tin is provided and additionally cooled by the cooling system 17 connected to the vessels 12 (not shown in FIG. 3). To this end, the cooling system 17 continuously supplies the vessels 12 with the cooled source material 13 and removes the heated source material 13 from the vessels 12 after contacting the revolving elements 11. Since the vessels 12 are open at the top, impairments in the radiation source 1 or the cooling system 17 can easily cause the source material 13 to overflow from the vessels 12. The source material 13 exiting from the electrode housings 20 is also discharged into the catch trough 30 in the tips 22 of the electrode housings 20.

For reasons relating to design, the possibilities for fixing the catch trough 30 inside the vacuum chamber 10 are limited in this embodiment of the radiation source 1. Therefore, it is not possible to arrange the catch trough 30 with the trough opening 37 (not shown in FIG. 3) directly below the tips 22 of the electrode housings 20. In vertical position, the catch trough 30 is in a lower position with respect to the electrode housings 20. In horizontal position, however, it has a lateral offset relative to a perpendicular extending from the tips 22. Therefore, a separate catch plate 60 for bridging the lateral offset is used in addition to the catch trough 30. The separate catch plate 60 extends the catching area of the catch trough 30 given by the trough opening 37.

Depending on the concrete constructive design of the radiation source 1, the catch plate 60 is arranged as an inclined surface inclined at an angle between 10° and 60° in direction of the perpendicular from below the tips 22 of the electrode housings 20 toward the catch trough 30. Its horizontal width is smaller than the catch trough 30 and its inclined length is large enough to bridge an offset between the tips 22 and the catch trough 30. The upper end of the catch plate 60 is arranged near the tips 22 of the electrode housings 20 so that the source material 13 exiting from the second openings 24 and flowing outward at the electrode housings 20 can drip from the tips 22 onto the catch plate 60 in line with the force of gravity. The catch plate 60 has peripheral edges 61 which are angled perpendicularly upward so that splashes dripping onto the catch plate 60 cannot escape from the sides.

The dripping source material 13 runs along the catch plate 60 to the lower edge of the catch plate 60. The lower edge forms a drip edge 62 which is arranged inside the catch trough 30 at the height of the maximum filling level 36 of the catch trough 30 and at which the source material 13 drips into the catch trough 30 from the catch plate 60.

Figure 4:
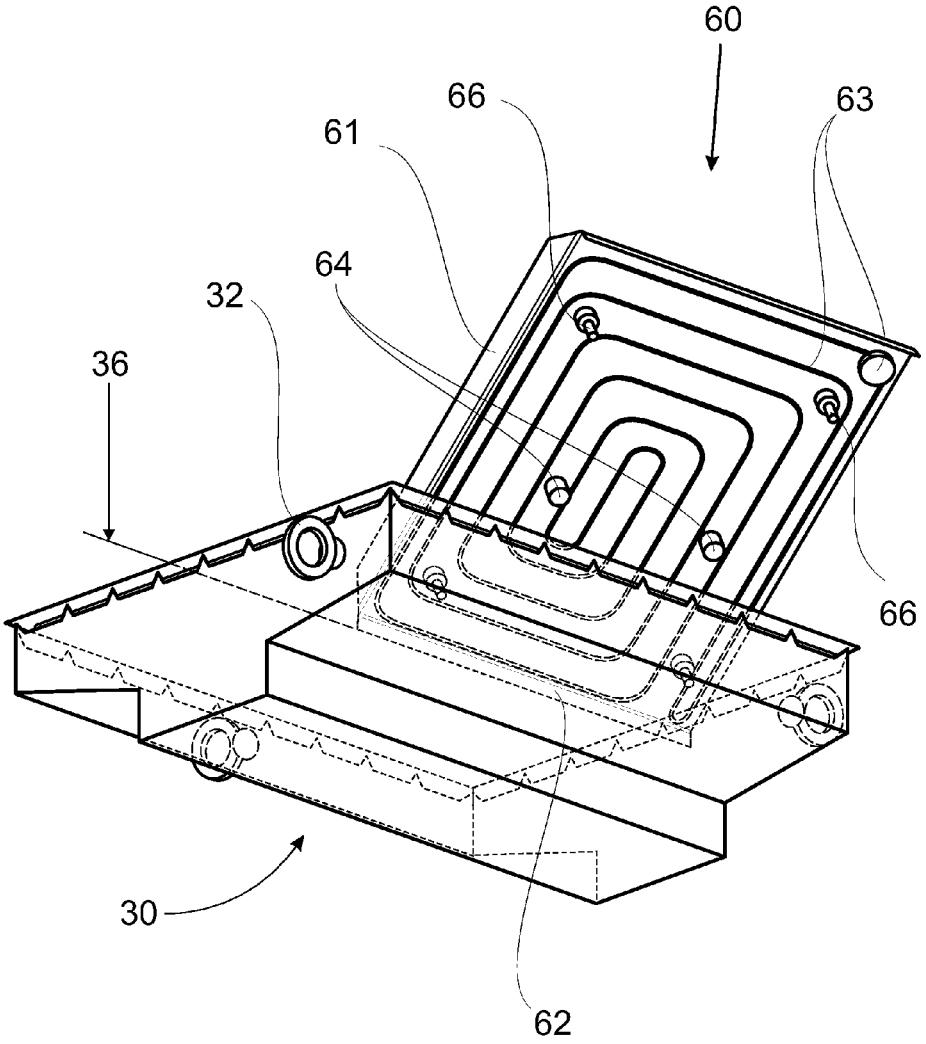
FIG. 4 is a design of the catch plate according to the embodiment of FIG. 3 with a heating element and temperature sensors as a combined arrangement of catch trough and catch plate, shown in a perspective view obliquely from below on the back side of the catch plate.

In FIG. 4 the catch plate 60 is shown in a perspective back side view obliquely from below. For sufficient resistivity and good thermal conductivity, the catch plate 60 is a stainless steel sheet. The catch plate 60 is provided with an additional heating element 63 in a manner analogous to the catch trough 30. The additional heating element 63 is preferably placed and fastened in a zigzagging manner to the back side of the catch plate 60 facing away from the electrode housings 20. In this way, the source material 13 dripping over the catch plate 60 can always be kept in molten state.

For monitoring the temperature of the catch plate 60, additional temperature sensors 64 are fastened to the back side of the catch plate 60. These preferably two additional temperature sensors 64 are arranged in each instance approximately perpendicularly below the tips 22 at points of impact 68 (only shown in FIG. 3) of source material 13 dripping from the electrode housings 20 and below a horizontal center line of the catch plate 60. In contrast to a single additional temperature sensor 64 which, for instance, is arranged in the middle of the catch plate 60 between the points of impact 68, the two additional temperature sensors 64 arranged exactly at the points of impact 68 have the advantage that, for instance, overflowing source material 13 can be detected without delay, since the distance between the points of impact 68 of the source material 13 and the additional temperature sensors 64 is very short. The additional temperature sensors 64 and the additional heating element 63 are connected to the control unit 70 to regulate the temperature of the catch plate 60.

Like the catch trough 30, the catch plate 60 is also constructed so as to be double-walled. The back side of the catch plate 60 is covered by a cover 65 to protect the additional temperature sensors 64 and the additional heating element 63 and for thermally insulating the additional heating element 63 from the vacuum chamber 10 of the radiation source 1 (in FIG. 4 the back side of the catch plate 60 is shown without the cover 65). To this end, the cover 65 is screwed to the catch plate 60, this screw connection being effected by means of a few (maximum of 4 to 6 units) threaded bolts 66 which are fixedly connected to the back side of the catch plate 60.

The catch plate 60 is fastened to a corresponding catch plate holder 67 inside the vacuum chamber 10 at the radiation source 1 by means of the threaded bolts 66 described above (only shown in FIG. 3). It has no connection to the catch trough 30.

In theory, the catch plate 60 could also be replaced by a corresponding extension of one of the converging side walls 41 of the inner trough 40. However, the separate catch plate 60 offers a number of advantages described in the following.

The separate collection at the catch plate holder 67 allows the position of the catch plate 60 to be adjusted laterally as well as with respect to inclination relative to the electrode housings 20 and the catch trough 30. This is particularly important for the amount of distance relative to the electrode housings 20 for preventing short circuits between the high-voltage electrode housings 20 and the catch plate 60. Owing to the fact that the catch plate 60 is separate from the catch trough 30, only the catch plate 60 needs to be moved in order to adjust the catch plate 60 and not the entire catch trough 30 with the high specific weight of the collected source material 13.

Because of the confined space conditions in the vacuum chamber 10, it is advantageous, in case the inner trough 40 is to be replaced or removed from the radiation source 1, when the inner trough 40 is not additionally increased in size by the diagonally protruding catch plate 60. In this way, removing or replacing the catch trough 30 becomes very easy and takes only a short time.

Further, the separate arrangement of the catch plate 60 allows a differentiated temperature measurement between the catch trough 30 and the catch plate 60. Since there is no thermal contact between the two, the respective other measurement remains unaffected by temperature differences between the catch trough 30 and the catch plate 60. In this way, particular operating states and fault conditions of the radiation source 1 can be recognized more quickly and reliably.

Further, the separate catch plate 60 makes it possible to use two separate heating elements 33 and 63 by which the catch trough 30 can be heated independently from the catch plate 60. When heating a molten metal that has solidified in the catch trough 30, the catch plate 60 can remain unheated. An additional and unnecessary heat input in the radiation source 1 during heating is reduced in this way.

Figure 5:
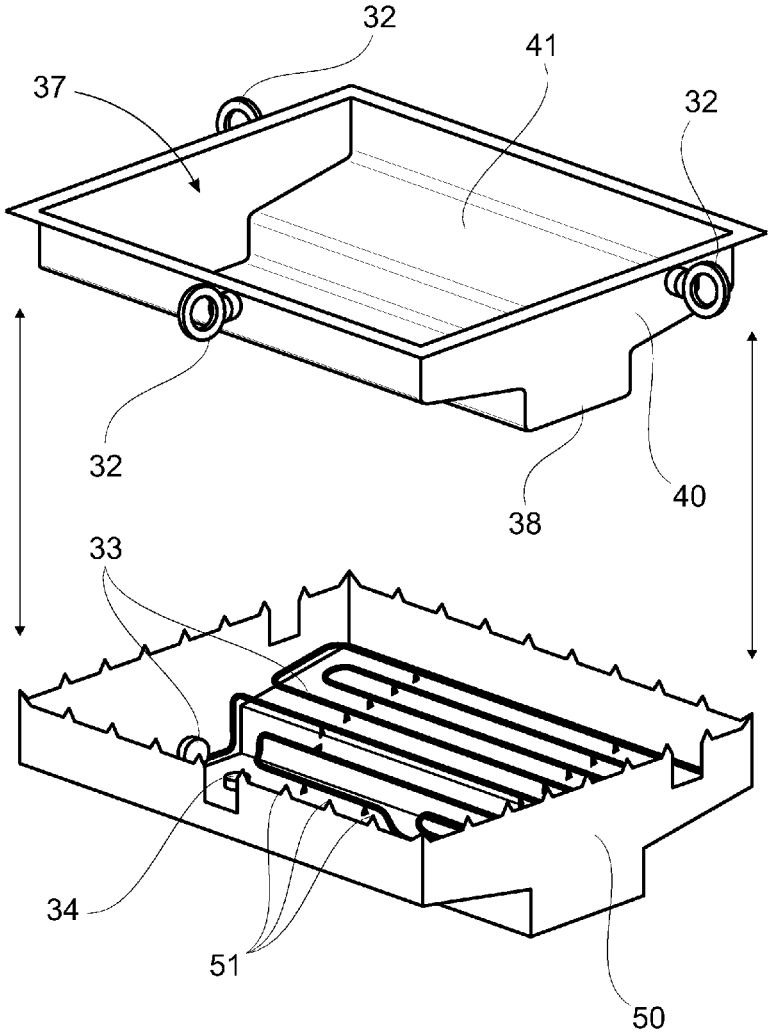
FIG. 5 shows an embodiment of the catch trough with an inner trough that can be removed from the outer trough and with heating elements and temperature sensors fastened in the outer trough in a perspective view obliquely from above.

In FIG. 5, the inner trough 40 and the outer trough 50 of the catch trough 30 (according to FIG. 3) are shown in a perspective view from above. The inner trough 40 is shown as being removed from the outer trough 50 so that the heating element 33, which is fastened to the inner side of the outer trough 50 and placed in the gap 52 in a zigzagging manner, and the temperature sensor 34 are visible.

The removable inner trough 40 allows a particularly convenient handling of the source material 13 collected in the catch trough 30. This is particularly advantageous if, instead of the cheap tin described here, significantly more expensive source materials 13, like for instance gadolinium or terbium, are used for generation of plasma emitting radiation with even shorter wavelengths. With these source materials 13 a most complete recycling is an essential cost factor.

As already described in connection with the first embodiment example, it is essential for an error-free functioning of the radiation source 1 that the source material 13 in the catch trough 30 is kept in molten state. To this end, the heating elements 33 are fastened to the catch trough 30 and additional heating elements 63 are fastened to the catch plate 60, as shown schematically in FIG. 6. According to the temperatures separately measured with the temperature sensors 34 of the catch trough 30 and the additional temperature sensors 64 at the catch plate 60 the heating elements 33 and 63 are also separately controlled by a PID controller 71 of the control unit 70. The control unit 70 can be influenced by means of a freely programmable control system 72.

The control unit 70 constantly keeps the temperature of the catch trough 30 and the catch plate 60 slightly above the melting temperature of the source material 13. When using tin, the catch trough 30 and the catch plate 60 are constantly heated up to at least 237° C., preferably to 242° C. The control unit 70 simultaneously reduces the heating of the source material 13 by switching off the heating elements 33 and 63 when they reach the maximum temperature. The maximum temperature for tin is about 400° C., because at temperatures exceeding this maximum temperature the corrosive effect of tin relative to the stainless steel of the catch trough 30 and the catch plate significantly increases.

Figure 6:
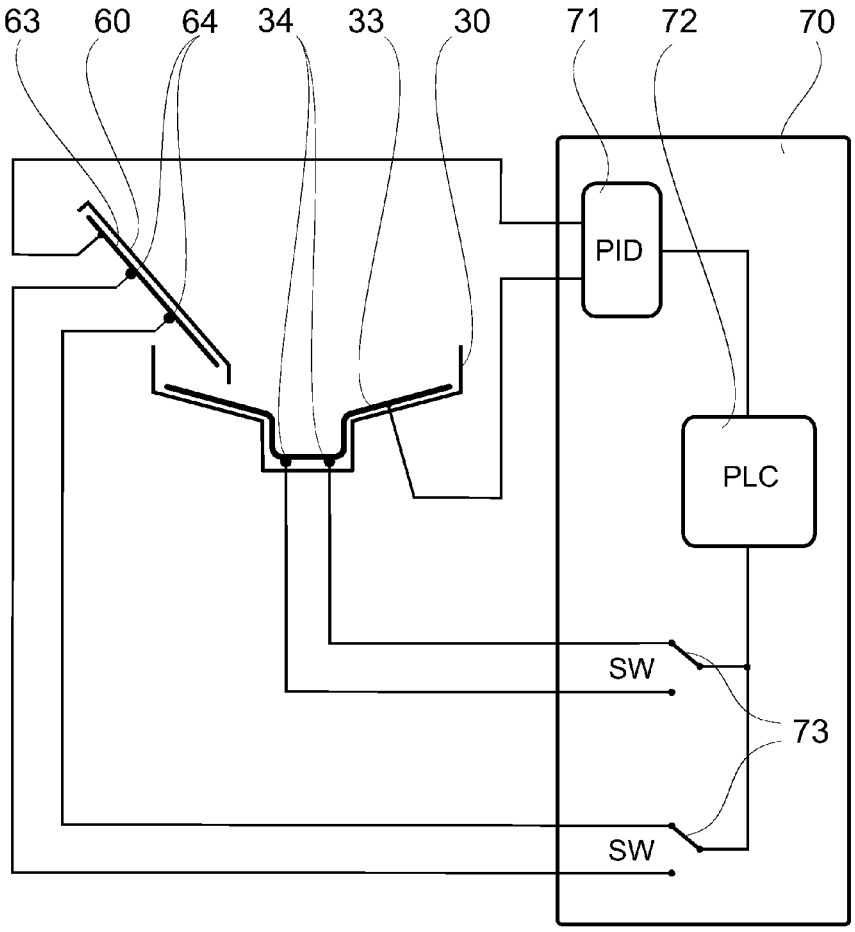
FIG. 6 is an example for the embodiment of the control unit for controlling the heating elements by analyzing several temperature sensors at the catch trough and the catch plate and FIG. 7 shows two diagrams with a depiction of the quantity-dependent different temperature curves in the melting and crystallization phase of the source material used.

In order to achieve a high degree of process security, the temperature sensors 34 and 64 in the embodiment example in FIG. 6 are redundant in each instance. The control unit 70 has a switch 73, one for the redundant temperature sensors 34 of the catch trough 30 and one for the redundant additional temperature sensors 64 at the catch plate 60, which switches between the temperature sensors 34 or 64 in case of impairments.

Continuous measurements in the control unit 70 allow conclusions with respect to the condition of the radiation source 1.

Figure 7:
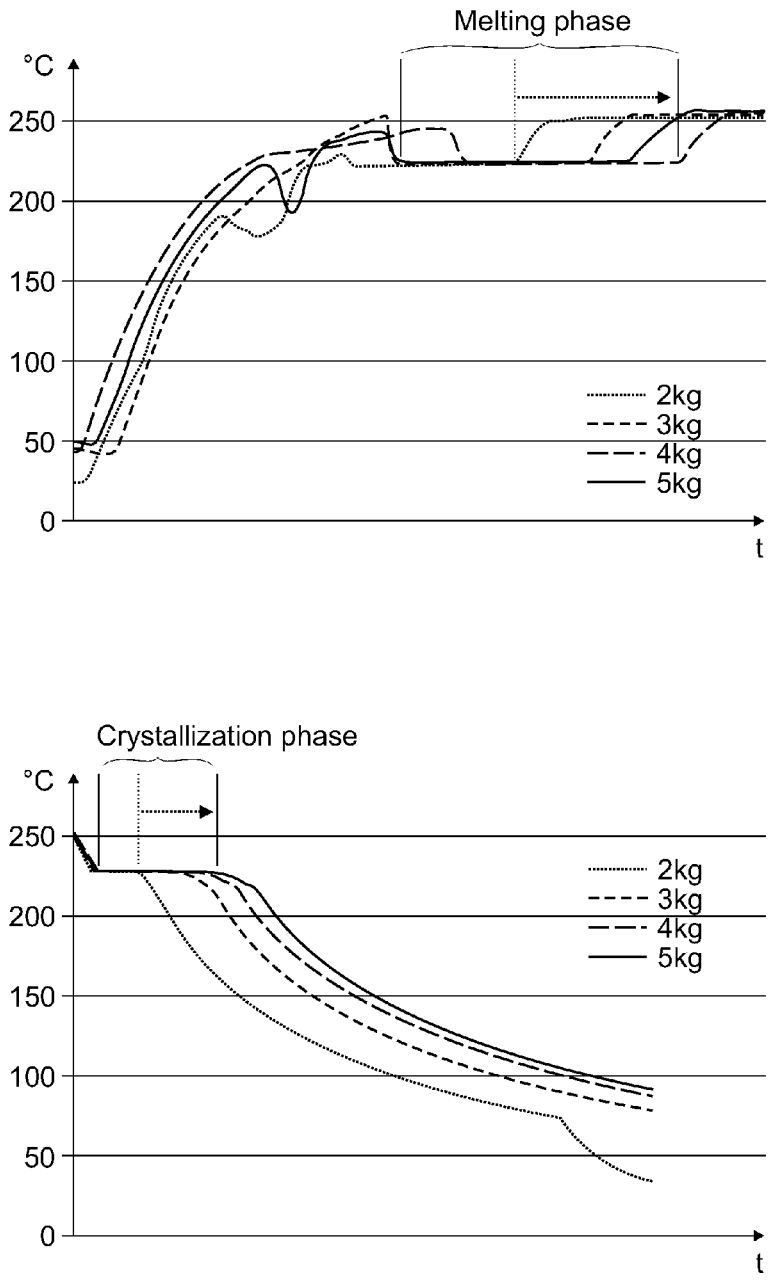

Temperature measurement curves as shown in FIG. 7 can provide information about an amount of source material 13 located in the catch trough 30 both during a melting phase (when the solidified metal is heated) and during a crystallization phase (when the molten metal is solidified) of the source material 13. In the melting and crystallization phase there are characteristic temperature curves in certain temperature ranges that can be analyzed. These are ranges within which the temperature of the source material 13 remains unchanged for a short time during heating or cooling. This is caused by endothermic or exothermic processes in the metal matrix of the source material 13 during the melting phase and the crystallization phase whose temporal progressions change proportional to the amount of source material 13. The larger the amount of source material 13 is, the longer the characteristic temperature curve.

Further it is possible to analyze an increase in temperature when the solidified source material 13 located in the catch trough 30 is heated. At a constant heating capacity of the heating element 33 the increase in temperature is proportional to the amount of source material 13 located in the catch trough 30. By means of reference values, the amount of source material 13 located in the catch trough 30 can also be determined from this increase, since a larger amount of source material 13 leads to a comparably slower and a smaller amount to a comparably faster increase in temperature.

The amount of source material 13 remaining in the radiation source 1 can indirectly be concluded from the determined amount of source material 13 collected in the catch trough 30 so that the control unit 70 can generate, for instance, error messages or maintenance instructions if the amount of source material is small. On the one hand, this is advantageous, since it is normally difficult to control the amount remaining in the radiation source 1 due to the complexity of the radiation source 1; on the other hand, continuous controlling is of essential importance, since operating the radiation source 1 with a too small amount of source material 13 can lead to a significant damage of the radiation source 1.

Impairments of the radiation source 1 can also be detected from the increase in temperature. If a sudden and continuing increase in temperature is measured at the catch plate 60, for instance, the source material 13 probably accumulates and subsequently overflows in one of the vessels 12. When detecting such characteristic temperature curve patterns the control unit 70 generates an error message.

In a further elaborated embodiment of the invention the loss of source material 13 provided for plasma generation from one of the vessels 12 can also be detected. In order to detect the consumption of source material 13 at any time, also without the temporary complete cooling of the catch trough 30, the heating element 33 of the catch trough 30 is operated with a defined temperature profile in normal operation of the radiation source 1. To this end, the normally constant heating capacity is operated with an alternatively rising or trailing heating current (i.e. an "alternating current" superimposed by a very low frequency and a defined profile) which further has an amplitude which constantly keeps the catch trough 30 at a temperature level moderately above the melting temperature of the source material 13. Over the period of the rising and/or trailing edge of the heating current a resulting increase and drop in temperature respectively is measured. Based on the temporal progression of the measured temperature the amount of source material 13 in the catch trough 30 can then be determined and the consumption of source material 13 prepared for the plasma generation can be calculated.

In a further embodiment both the heating element 33 and the temperature sensor 34 of the catch trough 30 are directly fastened to the outer surface of the inner trough 40. Here the inner trough 40 and the outer trough 50 are fixedly connected to one another via a detachable connection, wherein the catch trough 30 can be completely removed from the radiation source 1 or the vacuum chamber 10 by means of lifting eyes 32 (as shown in FIG. 4) which are fastened to the outer trough 50. Since the heating element 33 and the temperature sensor 34 are connected to the control unit 70 and these are removed from the radiation source 1 together with the catch trough 30, the connections have a separable electrical connector by means of which they can be separated from the control unit 70. In a further embodiment, the four side walls 41 of the catch trough 30 are arranged so as to converge in the middle in the shape of an inverted hip roof. The source material 13 collected in the catch trough 30 is concentrated in the center of the catch trough 30 through the force of gravity.

All of the surfaces of the catch trough 30 and catch plate 60 which are continually in contact with the source material 13 are provided with a coating to increase the resistance of the stainless steel. To this end, for example, a TiN coating can be used when tin is used as source material 13.

The catch plate 60 which is separately fastened in the radiation source 1 is electrically insulated from the catch trough 30 and the radiation source 1 and is used as a filling level sensor in this embodiment. To this end, the catch plate 60, as shown in FIG. 4, is oriented and fastened relative to the catch trough 30 so that its drip edge 62 ends exactly at the level of the maximum filling level 36 of source material 13 in the catch trough 30. If the filling level of source material 13 in the catch trough 30 rises to the maximum filling level 36, the drip edge 62 of the catch plate 60 comes into contact with the source material 13 and closes a circuit provided by the control unit 70 with which a filling level alarm is generated.

Commercial filling level sensors (not shown) fastened in or on the inner trough 40 can also be used to detect the maximum filling level 36 or the minimum filling level 35 or intermediate states between the minimum filling level 35 and the maximum filling level 36.

In another embodiment of the catch trough 30, which is modified compared to that of FIG. 1 or FIG. 2, the gap 52 between the inner trough 40 and the outer trough 50 can be used for deliberate cooling of the source material 13 located in the inner trough 40. To this end, there has to be an inlet and an outlet (not shown) through which a coolant can be discharged into the gap 52 between the inner trough 40 and outer trough 50 so that the gap 52 is passed through completely by the coolant. The control unit 70 can then control the temperature or the flow of the coolant. When using tin the temperature of the source material 13 with the coolant is to be kept below 400° C. but constantly above the melting temperature $T_S$. For any other source material 13 the temperature range above the melting temperature $T_S$ should be limited to $T_S$+150 K. Instead of determining the amount of source material 13 located in the catch trough 30 by on the basis of the increase in temperature during heating, as explained above, it is also possible to determine the amount when the source material 13 is cooled. By means of a constant volume current of the coolant flowing through the gap 52 the drop in temperature can be determined and the drop can be matched with the amount of source material 13 located in the catch trough 30 by means of reference values. In contrast to the determination of the amount during heating an influence of the temperature control by the control unit 70 can be precluded here so that the determination of the amount is more exact during cooling.

LIST OF REFERENCE NUMERALS

1 radiation source
10 vacuum chamber
11 revolving element
12 vessel
13 source material
14 plasma zone
15 plasma
16 laser
17 cooling system
20 electrode housing
21 electrode gap
22 tip
23 first opening
24 second opening
30 catch trough
31 supporting frame
32 lifting eye
33 heating element
34 temperature sensor
35 minimum filling level
36 maximum filling level
37 trough opening
38 deepest trough area
40 inner trough
41 side walls
50 outer trough
51 support point
52 gap
60 catch plate
61 peripheral edge
62 drip edge
63 additional heating element
64 additional temperature sensor
65 cover
66 threaded bolt
67 catch plate holder
68 point of impact
70 control unit
71 PID controller
72 programmable control system
73 switch

What is claimed is:

1. A radiation source for generating short-wavelength radiation from plasma comprising:

a molten bath of a liquid metal being a source material;

at least one revolving element partially immersed in the source material to carry the source material into a plasma zone;

at least one laser directed to the plasma zone for exciting the source material and a receptacle for collecting unused source material constructed as a catch trough having a trough opening below the plasma zone and below the molten bath in a direction of a force of gravity, at least one inclined side wall for catching and concentrating the unused source material in a deepest trough area of the catch trough;

at least one heating element attached to the catch trough for heating the unused source material to a temperature T above a melting temperature $T_S$ of the source material; and a control unit for controlling the temperature T in the catch trough with at least one temperature sensor attached to the catch trough.

2. The radiation source according to claim 1, wherein the catch trough comprises a double-walled vessel comprising an inner trough for receiving the unused source material and an outer trough enclosing the inner trough.

3. The radiation source according to claim 2, wherein the inner trough can be separated from the outer trough.

4. The radiation source according to claim 2, further comprising a gap provided between the inner trough and the outer trough for thermally insulating them from one another.

5. The radiation source according to claim 4, wherein the gap is provided for receiving the heating element.

6. The radiation source according to claim 4, wherein the gap is provided for circulating a coolant.

7. The radiation source according to claim 6, wherein a temperature of the coolant is controlled by the control unit, and wherein a temperature T of the unused source material is maintained within a predetermined range above the melting temperature.

8. The radiation source according to claim 1, wherein the catch trough has at least two facing side walls arranged to converge in the middle of the catch trough and be inclined in the direction of the force of gravity.

9. The radiation source according to claim 1, wherein at least the inner trough of the catch trough is made of a chemically and mechanically resistant, thermally and electrically conductive material.

10. The radiation source according to claim 9, wherein at least the inner trough of the catch trough is made of stainless steel sheet.

11. The radiation source according to claim 9, wherein at least the inner trough of the catch trough has a TiN coating.

12. The radiation source according to claim 1, wherein the catch trough has a filling level sensor for detecting a filling level of the unused source material in the catch trough.

13. The radiation source according to claim 1, further comprising a catch plate disposed above the catch trough the catch plate being oriented obliquely relative to the catch trough and has a drip edge terminating in the catch trough.

14. The radiation source according to claim 13, wherein the catch plate is electrically insulated from the catch trough, and wherein the drip edge can be used as a filling level sensor.

15. The radiation source according to claim 14, wherein the catch trough further comprises lifting eyes for removing the catch trough from the radiation source.

16. The radiation source according to claim 13, wherein the catch plate comprises at least one additional heating element and one additional temperature sensor.

17. The radiation source according to claim 1, wherein the catch trough is made removable from the radiation source.

18. The radiation source according to claim 1, wherein the catch trough further comprises lifting eyes for removing the catch trough from the radiation source.

19. The radiation source according to claim 1, wherein the control unit comprises a PID controller for controlling heating elements dependent on a detected temperature measured by the at least one temperature sensor.

20. The radiation source according to claim 1, the at least one temperature sensor is disposed below a minimum filling level of the unused source material in the catch trough.

21. The radiation source according to claim 1, wherein the control unit comprises means for detecting temperature increases indicative of an increase of the unused source material exiting from the plasma zone.

* * * * *